US006145777A

United States Patent [19]

Zach et al.

[11] Patent Number: 6,145,777

[45] Date of Patent: Nov. 14, 2000

[54] SINGLE STATION CONTINUOUS LOG ROLL WINDER

[75] Inventors: Mark J. Zach, Northfield; Leonard M. Volin, Grant; Gary J. Goth, Rogers; Jeffrey J. Fontaine, Woodbury, all of Minn.

[73] Assignee: 3M Innovative Properties Company, St. Paul, Minn.

[21] Appl. No.: 09/301,204

[22] Filed: Apr. 28, 1999

[51] Int. Cl.[7] ..... B65H 19/26

[52] U.S. Cl. ..... 242/533; 242/527

[58] Field of Search ..... 242/527, 527.3, 242/527.4, 532.2, 532.3, 533, 533.3, 548, 541.5, 541.6

[56] References Cited

U.S. PATENT DOCUMENTS

| | | | |
|---|---|---|---|
| 2,585,226 | 2/1952 | Christman | 242/527 |
| 2,845,231 | 7/1958 | Grettve | 242/527 |
| 2,872,126 | 2/1959 | Rockstrom et al. . | |
| 3,567,552 | 3/1971 | Heuff et al. . | |
| 3,794,255 | 2/1974 | Harmon et al. . | |

(List continued on next page.)

FOREIGN PATENT DOCUMENTS

| | | |
|---|---|---|
| 0 335 028 | 10/1989 | European Pat. Off. . |
| 0 657 374 A1 | 6/1995 | European Pat. Off. . |
| 2 019 873 | 7/1970 | France . |
| 2 336 334 | 7/1977 | France . |
| 2 387 102 | 11/1978 | France . |
| 2 499 958 | 8/1982 | France . |
| 29 23 559 | 1/1981 | Germany . |
| 32 17 628 | 3/1983 | Germany . |
| 1137221 | 12/1968 | United Kingdom . |
| 1164885 | 9/1969 | United Kingdom . |
| 1167767 | 10/1969 | United Kingdom . |
| 1207080 | 9/1970 | United Kingdom . |
| WO 87/06218 | 10/1987 | WIPO . |

OTHER PUBLICATIONS

*Fast Optical Cross–And Auto–Correlator*, 24945, Research Disclosure, Jan. 1985.

*Automatic Shore Roll Winder*, Info–Blattnach M19431 (1), Stahlkontor Maschinenbau GmbH, Baumert, Sep. 25, 1985 (English Translation).

LeMin, *Short Liner, Short–roll inder for self–adhesive soft films*, Stahlkontor Technical Information.

Lind Bell Industrial Co., Ltd., *RW–5, Auto Log Rewinder*, LBI Converter.

Lind Bell Industrial Co., Ltd., *RW–6, High Speed Automatic Log Roll Winding Machine*, LBI Converter.

*Primary Examiner*—Donald P. Walsh
*Assistant Examiner*—Collin A. Webb
*Attorney, Agent, or Firm*—Charles D. Levine

[57] ABSTRACT

A tail gap winder transfers a web from a first core to a second core by, immediately after the web is cut, pivoting the idler roller to lengthen the distance between the idler roller and the rotating drum to create a gap between the cut ends of the web; removing the first core from the rotating drum surface as the gap passes under the first core location; moving the second core into contact with the rotating drum surface; and winding the incoming cut edge around the second core. The idler roller pivots toward the rotating drum to decrease the distance between the idler roller and rotating drum and to take up the extra length of web during the winding portion of the operating cycle.

11 Claims, 2 Drawing Sheets

U.S. PATENT DOCUMENTS

| | | | |
|---|---|---|---|
| 4,105,170 | 8/1978 | Schonmeier | 242/541.6 |
| 4,157,794 | 6/1979 | Brandauer et al. . | |
| 4,370,193 | 1/1983 | Knauthe | 242/532.3 X |
| 4,422,588 | 12/1983 | Nowisch . | |
| 4,485,979 | 12/1984 | Dropczynski . | |
| 4,487,377 | 12/1984 | Perini . | |
| 4,601,441 | 7/1986 | Oinonen et al. . | |
| 4,635,867 | 1/1987 | Kytönen . | |
| 4,659,029 | 4/1987 | Rodriquez . | |
| 4,678,133 | 7/1987 | Suzski . | |
| 4,700,905 | 10/1987 | Oppelt et al. . | |
| 4,709,867 | 12/1987 | Oinonen . | |
| 4,712,459 | 12/1987 | Walkiewicz, Jr. et al. . | |
| 4,723,724 | 2/1988 | Bradley . | |
| 4,746,076 | 5/1988 | Tomma et al. | 242/541.5 X |
| 4,749,139 | 6/1988 | Snygg . | |
| 4,775,110 | 10/1988 | Welp et al. . | |
| 4,842,209 | 6/1989 | Saukkonen . | |
| 4,852,820 | 8/1989 | Looner . | |
| 4,856,725 | 8/1989 | Bradley . | |
| 4,858,843 | 8/1989 | Gierse et al. . | |
| 4,867,387 | 9/1989 | Schönmeier . | |
| 4,883,233 | 11/1989 | Saukkonen et al. | 242/541.5 X |
| 4,919,351 | 4/1990 | McNeil . | |
| 4,964,585 | 10/1990 | Negrussi . | |
| 5,031,850 | 7/1991 | Biagiotti . | |
| 5,346,150 | 9/1994 | Volin . | |
| 5,379,962 | 1/1995 | Albrecht et al. . | |
| 5,441,211 | 8/1995 | Ueda et al. | 242/527.3 X |
| 5,639,045 | 6/1997 | Dorfel | 242/527 |

SINGLE STATION CONTINUOUS LOG ROLL WINDER

TECHNICAL FIELD

The present invention relates to log roll winders. More particularly, the present invention relates to log roll winders with improved web transfer between cores.

BACKGROUND OF THE INVENTION

Most known log roll winders cut the web while the web is in the air, rather than against a drum. Winders of this type are made by Fuji Tekko. As the knife cuts, it forces the web against a new core. However, because the tail of the web is not supported, the web, particularly thin webs, will not lay down smoothly against the core and wrinkles are produced on the outer wraps.

U.S. Pat. No. 4,775,110 to Welp et al. describes a winding system in which a complex cutting system is used to sever the web. One cutter perforates the web along a line and the web is braked to sever the web. Cutting is not performed on the fly. A hot wire can be used as a cutter and a vacuum can be used on the feed drum to secure the web.

Some continuous, high speed log roll winders which wind a continuous web of material around large rolls or drums transfer the web to a core on a wind-up spindle disposed against the drum. In one system, the winding is transferred from one wind-up spindle to another simply by moving the wind-up spindles against and away from the rotating drum. However, this requires precise timing. When transferring from the first wind-up spindle to the second wind-up spindle, the first wind-up spindle must be lifted off of the rotating drum before the cut end arrives. In doing this, the last portion of the web wrapped on the first wind-up spindle is uncontrolled and must be prevented from wrinkling. When transferring from the second to the first wind-up spindle, the first wind-up spindle must be moved against the rotating drum before the cut end arrives. Then the web is peeled off of its core on the second wind-up spindle while being prevented from wrinkling.

A roll winder made by Stahlkontor Maschinenbau GmbH winds a web at only one wind-up location. The web, drum, and wind-up roll stop for the web to be cut before the drum. Following the cut, the drum and roll of web resume turning to wind the tail of the web while the incoming web remains stopped. Next, the roll of web is unloaded, and an empty core is loaded in its place. Finally, the winder begins winding on the new core. This winder does not cut and transfer web on the fly. If the winder is used to wind on-line at the end of a continuous web maker, an accumulator is required to absorb incoming web during the cut and transfer, and web speeds are limited to 60 m/min to prevent tension problems. Additionally, the Stahlkontor machine cuts the web before it contacts the drum, leaving the web prone to wrinkling.

In the rewinder of U.S. Pat. No. 4,487,377 to Perini, after the web is cut, the leading edge of the web is permitted to fly rearwardly off of the main winding drum. This folded back portion is subsequently adhered to a core to begin winding another roll. No function for folding back the beginning portion of the web is disclosed.

U.S. Pat. No. 5,346,150 to Volin creates a gap between the cut ends of the web on the surface of the drum during the cut and transfer operation of the winder. The web is always supported during the cut and transfer. This enables the winder to cut and transfer the web on the fly at speeds of 137.2 m/min (450 ft/min) or more. This also permits winding and cutting the web against the drum and without wrinkling the web. This system uses two separate wind-up spindles on which the web is alternately wound.

DETAILED DESCRIPTION

This invention is a log roll winder for webs, such as adhesive tape, which achieves continuous web speed winding and transfers with only a single wind-up station. Winding is transferred from a completed roll to a new core without stopping the web, and with only a single wind-up station. Previously, log roll winders required two or more wind-up stations to achieve continuous operation. Known log roll winders with only one wind-up station require a lengthy duration of stopped web (at least 5 seconds) to transfer winding to a new roll. This invention reduces the complexity of continuous log roll winders.

This invention will be used to provide continuous web-speed log roll winding equipment for lower web speed applications, such as those at speeds below 137.2 m/min (450 ft/min). This expands the utility of 3M-developed "tail gap" type log roll winders (described in the '150 patent) to lower web speed applications by reducing winder complexity. This invention is also well-suited for log rolls of very short product length because of its very fast cycle time.

Figure 1:
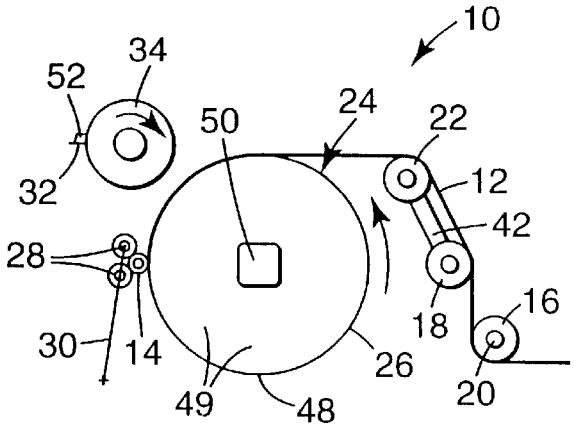
FIGS. 1, 2, and 3 are sequential schematic views of the winding system of the present invention.

The winding system 10 of the present invention, shown in FIG. 1, can be used in conjunction with most known tapes. After the web 12 is processed it is wound on a core 14 at a wind-up station. The winding system 10 includes a "tail gap mechanism" (which includes a roller 18, an idler roller 22, and an arm 42, described below) and permits transferring the web 12 between cores 14 on the fly. This system 10 includes numerous rollers 16, one of which is shown, which can be idler rollers or driven rollers. The winding system 10 also includes a stationary gapping roller 18 (which is optional) around which the web 12 travels. The roller 18 may spread the web 12 and eliminates wrinkles before the web 12 travels to a rotating drum 24. A tension sensor 20 can be mounted on one roller 16 to measure web tension and adjust the speed of the rotating drum 24 to maintain a set tension. Alternatively, the tension sensor can be located elsewhere, such as on the roller 22. The web 12 then travels to a retractable primary gapping roller or idler roller 22 which is disposed downline of the roller 18. The idler roller 22 is pivotable on a radius centered at the center of the roller 18. The idler roller 22 and the roller 18 can have the same diameter and the same circumference.

The rotating drum 24 is disposed downline of the idler roller 22 such that the web 12 travels in intimate contact with a portion of the surface 26 of the rotating drum 24 after passing the idler roller 22. The rotating drum 24 has an outer surface 26 covered with urethane rubber or other material which firmly supports the web 12 such that a cutting knife will penetrate the web 12 when the knife is pressed against the web 12. The drum surface 26 can be steel or other hard material, as long as the knife travel is precisely controlled to avoid knife damage. Also, the surface 26 can have a narrow groove which would engage the knife such that the edges of the groove would support the web 12 close to the cut while the cut is actually made in the open air space between the edges of the groove. The web 12 can have an adhesive side which generally faces outwardly when the web 12 is wrapped around the rotating drum 24.

A pair of cradle rollers 28 support and hold the core 14 against the surface 26 of the rotating drum 24. The cradle rollers 28 are movable between a first position in which the core 14 contacts the rotating drum 24 (shown in FIG. 1) and a second position spaced away from the rotating drum 24 (shown in FIG. 3), to permit a wound log roll 40 on a first core 14 to be removed from the wind-up station, such as by gravity, and to permit a second core 14 to be located against the rotating drum 24. This is discussed in detail below. The cradle rollers 28 can be mounted on a cradle roller arm 30 which moves between the first and second positions. The arm is shown as pivoting, although translational and other motion can be used. Alternatively, the cradle rollers 28 can be mounted on slides or other devices.

Figure 5:
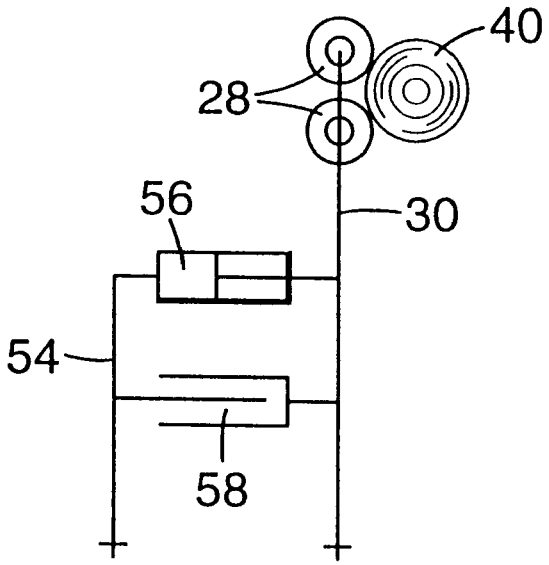
FIG. 5 is a schematic view of a modification of the present invention.

As shown in FIG. 5, a secondary arm 54 can be connected to the cradle roller arm 30, such as by a fluid cylinder 56, to position and apply force to the cradle roller arm 30 and move the cradle roller between the first and second positions. This arrangement can provide the high force needed to position quickly the cradle roller arm 30 for unloading and loading, and can provide the controllable lower force needed to hold the core 14 against the rotating drum 24 during winding.

Optionally, the secondary arm 54 can also be connected to the cradle roller arm 30 by a clutching device 58 as well as the fluid cylinder 56. The clutching device 58 can provide a rigid link between the cradle roller arm 30 and the secondary arm 54 during the unloading and reloading part of the cycle such that the position of a secondary arm 54 controls the position of the cradle roller arm 30. During the winding part of the cycle, the clutch can allow freedom of motion between the two arms 30, 54 so that the fluid cylinder 56 can apply a predetermined force to the cradle roller arm 30 and thus to the cradle rollers 28.

A cutting knife 32 is located upline of the cradle rollers and cuts the web 12 as the web 12 rotates against the rotating drum 24. The knife 32 can be mounted on a rotating wheel 34. The knife 32 cuts the web 12 against the rotating drum 24 which, through an internal vacuum arrangement, holds the cut ends 36 of the web 12 to prevent wrinkling. A tab 38 can be applied on at least one of the cut ends 36 of the web 12. Web cutting and tab application can be performed on the fly; these operations are performed without stopping the winding process such that log rolls 40 can be wound on line and at machine speeds on a continuous basis.

The idler roller 22 is mounted on an arm 42 which pivots around the center of the roller 18. The idler roller 22 pivots from a first position in which winding occurs and a second position which lengthens the distance, known as the pass line, between the idler roller 22 and the rotating drum 24 to create a gap 44 between the cut ends 36 of the web 12. Immediately after the web 12 is cut the idler roller 22 pivots to lengthen the pass line to cause the web 12 to slide on the surface 26 of the rotating drum 24 and create the gap 44 between the cut ends 36 of the web 12. The idler roller 22 is pivoted by an index mechanism (not shown) which can be a mechanical cam or an electrical drive such that the pivot speed is a function of the line speed.

Figure 2:
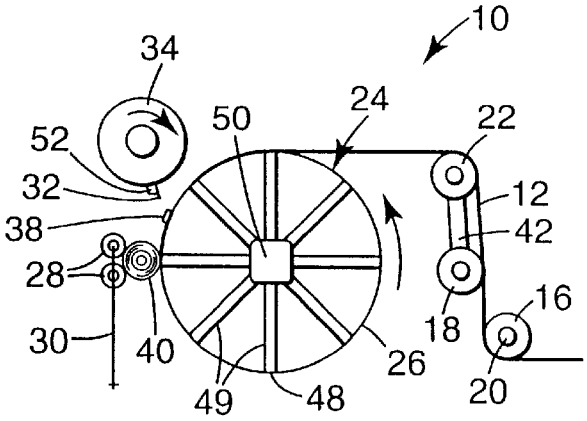
Figure 3:
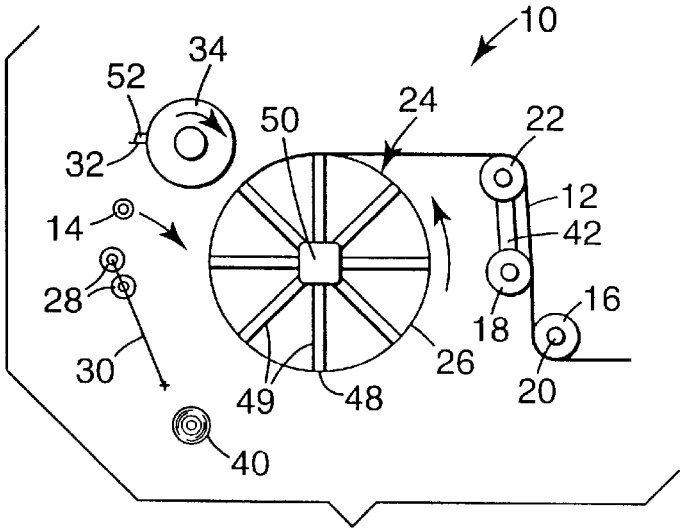

The rotating drum 24 includes a series of holes 48 on its surface which are connected to a source of vacuum 50. The drum 24 can be hollow, as shown in FIG. 1, or the drum can be solid with passages 49 connecting the holes 48 to the source of vacuum 50, as shown in FIGS. 2 and 3. Any method of drawing vacuum can be used. The vacuum source 50 provides a mechanism for increasing friction between the web 12 and the rotating drum 24 and for maintaining the web 12 in close contact with the rotating drum 24 during winding. The vacuum can be varied by any known method so that the friction between the web 12 and the drum 24 can be varied at different points in the operation of the system. The friction can be reduced while the web 12 slides on the surface of the drum 24. When the web 12 slides on the rotating drum surface 26 by pivoting the idler roller 22, the vacuum 50 controls the sliding force of the web 12 on the rotating drum 24 to maintain a constant line tension. The vacuum applied to the surface 26 of the drum 24 can be constant. Alternatively, such as when winding vinyl webs which are easily stretched, a variable vacuum can be applied. A low vacuum force is used while increasing the gap to prevent stretching, and a higher vacuum force is used during the remainder of the cycle to maintain contact between the web 12 and the drum 24.

The operation of the winding system 10 is as follows. As shown in FIG. 1, the web 12 first passes around the roller 18 as the tension sensor 20 provides a signal for use in maintaining web tension. The web 12 then travels to and around the retractable idler roller 22 before being wrapped partially around the rotating drum 24 with the adhesive side of the web 12, if one exists, facing outwardly. This prevents the web 12 from adhering to the drum surface 26 and permits the web 12 to transfer to the cores by adhesion. Adhesion transfer to the cores with nonadhesive webs can be accomplished by placing adhesive directly on the cores. The web 12 travels in intimate contact with the drum 24 as the rotation of the rotating drum 24 passes the web 12 onto the core 14. (If an adhesive side faces the drum surface 26, the drum surface can be a non-stick surface that facilitates allowing the web 12 to be removed from the drum 24 during normal operation.)

The web 12 begins winding around a first core 14 at the wind-up station. When winding on the first core 14, the core 14 is located against the rotating drum 24. When the first core 14 has received the required length of web 12, the knife wheel 34 rotates at a surface speed equal to the surface speed of the rotating drum 24. The knife wheel 34 can be rotated by a knife drive (not shown) which is linked either mechanically or electrically to the drum 24. The knife drive can be actuated when a predetermined length of web 12 has been wound. The distance between the center of the knife wheel 34 and the drum 24 can be changed to adjust the depth of penetration of the knife into the urethane covering of the drum 24.

As the knife wheel 34 rotates and reaches the web 12, the cutting edge of the knife 32 contacts the web 12. The knife 32 cuts the web 12 as the web 12 rotates against the rotating drum 24 and a tab 38 can be applied to the cut end of the web by a tab bar 52 which, as shown in FIG. 2, can be located on the rotating wheel 34 adjacent the knife 32. The tab bar 52 applies a tab onto the web 12 in registration with the cut end 36 of the web 12. Alternative tab application assemblies can be used.

Figure 4:
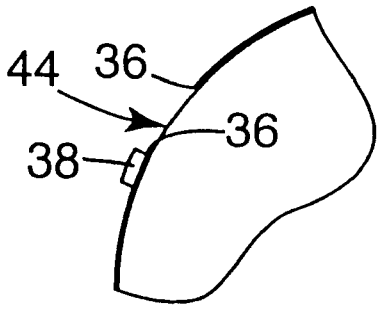
FIG. 4 is an enlarged portion of FIG. 2 showing the gap.

Immediately after the knife 32 cuts the web 12, the idler roller 22 is pivoted on its pivoting arm 42 on a radius centered at the center of the roller 18 away from the rotating drum 24 to lengthen the pass line between the idler roller 22 and the drum 24. The idler roller 22 pivots at a speed approximately equal to the web speed. This can cause the web 12 to slide on the surface 26 of the drum 24. Since the rotating drum 24 continues to rotate at a constant speed, this creates a gap 44 between the cut ends 36 of the web 12 as shown in FIGS. 2 and 4. (Alternatively, the drum 24 can vary its rotation during this stage of operation.) The gap 44 is equal to the pass line length increase. Another way to consider the gap is that it is the length of drum 24 circumference that passes a point without web 12 after the knife 32 cuts the web 12. The increase in pass line length and therefore the gap 44 can be 15 cm (6 in). By using a longer arm 42, the gap 44 can be increased. Gaps 44 of 45 cm (18 in) or more can be used. (Increasing the gap can accommodate faster web winding speeds.)

When the gap 44 reaches the single wind-up station, the cradle rollers 28 move away from the completed roll 40 of product web 12, allowing it to fall from the wind-up position by gravity, as shown in FIG. 3. At the same time, a mechanism inserts a new core 14 into contact with the rotating drum surface 26. Then the cradle rollers 28 move toward the drum 24 to hold the core. The drum 24 continues to turn so that when the incoming cut end 36 of the adhesive coated web touches the new core, winding of a new log roll is begun.

During the winding portion of the operating cycle, the idler roller 22 slowly pivots toward the rotating drum 24 and returns to its position of short pass line shown in FIG. 1. As the idler roller 22 moves toward this position, the pass line length between the idler roller 22 and rotating drum 24 decreases while the speed of the drum 24 can increase slightly to maintain constant line tension and to take up the extra length of web 12. The drum speed increase depends on the actual return speed and is accomplished in the drive for the drum 24 and is modified by the tension sensor signal. The process then repeats. Alternately, a constant drum speed can be used with variable web slippage on the drum.

This winding system 10 increases the time available to perform the transfer between the two cores 14 at a single wind-up station with a greatly simplified design. By creating a tail gap 44, the cut end of the web 36 is pulled away from the knife 32 after the web 12 is cut to prevent the cut ends 36 of the web 12 from sticking to each other or to the knife 32. The cut and transfer is made on the fly. This means that it is made at full line speed, with the upstream web speed and rotational inertia through the roller 18 and idler roller 22 remaining constant. This eliminates speed and inertia-related upsets from the upstream equipment.

This system can be used on continuous or non-continuous speed drum winders, with slit or unslit webs, and with adhesive-coated or non-coated webs. This system also can be used where turrets or other mechanisms move the cradle rollers into wind-up position. However, the tail gap simplifies the transfer operation to a sufficient degree to obviate the need for turret mechanisms. Moreover, this winding system is simpler, less expensive, more versatile, and more reliable than known winding machines.

This winding system 10 provides a gap without causing web tension upsets from roll inertia. Because the speed of the web through the system and hence the rotational speed of the rollers remains constant throughout the gap generation there are no tension upsets caused by the inertia of the idler rollers. This is accomplished simply by the geometry of the system 10. Roll inertia problems can be overcome by other systems. For example, a precision drive could be used on each roller affected by rotational speed changes to power the roller at the precise speed profile required to match the web speed at that roller and aprevent roll inertia from upsetting web tension. Also, rollers could be replaced by slider or floatation bars on which the web freely slides to avoid upset web tension.

This winding system 10 minimizes the time required to remove a completed roll from the wind-up station, reload a core into the wind-up station, and return the cradle rollers to the drum to be ready for winding. This can be accomplished in less than 0.25 second. This rapid cycle time makes it possible to achieve continuous, constant speed operation for a low cost winder with only one wind-up station. This is not possible or conceivable with known systems. The winding system 10 creates a lower cost continuous winder through the unobvious combination of a gap creating mechanism with a single winding station. It can operate at full line speeds of up to 61 m/min (200 ft/min) and higher. Increasing the gap length can accommodate higher web speeds. This invention operates continuously at full speed, and eliminates wrinkles at transfer. In addition, this winder is lower in cost, making it more economically viable than multiple position winders for applications within its speed capability. Also, because of the very quick transfer cycle, this winder can economically produce very short product length log rolls.

What is claimed is:

1. A winding system for winding a web on cores and for transferring the web to successive cores at a single wind-up station on the fly, comprising:

a rotatable drum having a surface, wherein the web travels in contact with a portion of the surface of the rotating drum;

a retractable idler roller located upstream near the rotating drum, wherein the idler roller is movable toward and away from the rotating drum;

means for cutting the web;

means for moving the idler roller away from the rotating drum immediately after the web is cut to lengthen the distance between the idler roller and the rotating drum to create a gap between the cut ends of the web; and means for supporting a core adjacent the rotating drum at the single wind-up station to permit winding the web on the core, wherein the means for supporting a core comprises means for moving a first core having web wound on it away from the single wind-up station, and for moving a second core into contact with the rotating drum at the single wind-up station to permit winding of web on the second core, on the fly without stopping the winding operation.

2. The winding system of claim 1 wherein the means for supporting a core comprises at least two cradle rollers movable between a first position in which they support a core adjacent the rotating drum and a second position in which they permit removal of the core from adjacent the rotating drum and permit insertion of another core.

3. The winding system of claim 2 wherein the means for supporting a core further comprises means for moving the cradle rollers between the first and second positions.

4. The winding system of claim 3 wherein the means for moving the cradle rollers comprises a cradle roller arm, a secondary arm connected to the cradle roller arm, and means for positioning and applying force to the cradle roller arm.

5. The winding system of claim 1 further comprising means for moving the idler roller toward the rotating drum to decrease the distance between the idler roller and the rotating drum while the speed of the drum increases to maintain constant line tension and to take up the extra length of web during winding.

6. The winding system of claim 1 further comprising a first roller around which the web travels; wherein the rotating drum is located downline of the first roller; wherein the retractable idler roller is located between the first roller and the rotating drum; and wherein the idler roller is pivotable on a radius centered at the center of the first roller.

7. The winding system of claim 1 wherein the rotating drum comprises means for increasing friction between the web and the rotating drum and for maintaining the web in contact with the rotating drum during winding.

8. The winding system of claim 7 wherein the friction increasing and contact maintaining means comprises a vacuum applied to the web through the rotating drum wherein when the web slides on the rotating drum surface by pivoting the idler roller, the vacuum controls the sliding force of the web on the rotating drum and to maintain a constant line tension.

9. A method of transferring the winding of a web from a first core to a second core at a single wind-up station and on the fly after the web is transported to and around a retractable idler roller, wrapped partially around a rotatable drum such that the web travels in contact with a portion of the surface of the drum, transported from the rotating drum onto the first core, wound around the first core until the first core has received a predetermined length of web, and cut, the method comprising the steps of:

lengthening the distance between the idler roller and the rotating drum after the web has been cut to create a gap between the cut ends of the web;

allowing the first core to move away from the rotating drum surface as the gap passes under the wind-up station location;

moving the second core into contact with the rotating drum surface as the first core moves away; and winding the incoming cut end around the second core at the single wind-up station on the fly without stopping the winding operation.

10. The method of claim 9 further comprising the step of decreasing the distance between the idler roller and rotating drum while the speed of the drum increases to maintain constant line tension and to take up the extra length of web during the winding portion of the operating cycle.

11. The method of claim 10 wherein the lengthening step comprises moving the idler roller away from the rotating drum and the decreasing step comprises moving the idler roller toward the rotating drum.

* * * * *